United States Patent [19]

Kawamura et al.

[11] Patent Number: 4,769,639

[45] Date of Patent: Sep. 6, 1988

[54] LIQUID CRYSTAL DRIVE CIRCUIT FOR DRIVING A LIQUID CRYSTAL DISPLAY ELEMENT HAVING SCANNING AND SIGNAL ELECTRODES ARRANGED IN MATRIX FORM

[75] Inventors: Masao Kawamura; Minoru Usui; Saburo Kobayashi, all of Tokyo, Japan

[73] Assignee: Casio Computer Co., Ltd., Tokyo, Japan

[21] Appl. No.: 891,523

[22] Filed: Jul. 31, 1986

[30] Foreign Application Priority Data

Sep. 25, 1985 [JP] Japan ..... 60-211434

[51] Int. Cl.[4] ..... G09G 3/36

[52] U.S. Cl. ..... 340/784; 340/811; 340/793; 350/332

[58] Field of Search ..... 340/784, 765, 811, 812, 340/813, 793; 350/332, 333, 336; 358/230, 236

[56] References Cited

U.S. PATENT DOCUMENTS

| | | | |
|---|---|---|---|
| 3,896,430 | 7/1975 | Hatsukano | 340/765 |
| 3,900,742 | 8/1975 | Hampel et al. | 307/464 |
| 3,903,518 | 9/1975 | Hatsukano | 340/784 |
| 3,936,676 | 2/1976 | Fujita | 340/784 |
| 3,945,000 | 3/1976 | Suzuki et al. | 340/756 |
| 4,038,564 | 7/1977 | Hakata | 340/813 |
| 4,348,666 | 9/1982 | Ogita | 340/793 |
| 4,581,654 | 4/1986 | Kobayashi et al. | 358/230 |

FOREIGN PATENT DOCUMENTS

| | | | |
|---|---|---|---|
| 0210421 | 11/1984 | Japan | 350/332 |
| 61-124 | 1/1986 | Japan . | |
| 61-20000 | 5/1986 | Japan . | |

*Primary Examiner*—Donald J. Yusko
*Assistant Examiner*—Alvin Oberley
*Attorney, Agent, or Firm*—Frishauf, Holtz, Goodman & Woodward

[57] ABSTRACT

A liquid crystal drive circuit includes a first buffer circuit for outputting a selection high level segment voltage V0' using a nonselection high level common voltage V1 from a common voltage generator as a reference, and a first operational amplifier for outputting a nonselection high level segment voltage V2' having an inverted voltage level of the selection high level segment voltage. The liquid crystal drive circuit also includes a second buffer circuit for outputting a selection low level segment voltage V5' using a nonselection low level common voltage V4 as a reference, and an operational amplifier for outputting a nonselection low level segment voltage V3' having an inverted voltage level of the nonselection low level segment voltage.

2 Claims, 7 Drawing Sheets

LIQUID CRYSTAL DRIVE CIRCUIT FOR DRIVING A LIQUID CRYSTAL DISPLAY ELEMENT HAVING SCANNING AND SIGNAL ELECTRODES ARRANGED IN MATRIX FORM

BACKGROUND OF THE INVENTION

The present invention relates to a liquid crystal drive circuit for driving a liquid crystal display element having scanning and signal electrodes arranged in matrix form.

Liquid crystal television receivers having liquid crystal display panels as display screens have been commercially available as portable compact television receivers in recent years. Liquid crystal color television receivers with color liquid crystal panels are being developed. Various methods can be utilized for color liquid crystal display. As shown in FIG. 1, primary color filters 1 of R (red), G (green), and B (blue) are connected to signal electrodes to constitute a typical conventional color liquid crystal panel 2. Color display is performed by a combination of three primary colors. Referring to FIG. 1, reference numeral 3 denotes a scanning electrode driver; 4, an R signal electrode driver; 5, a G signal electrode driver; 6, a B signal electrode driver; and 7, a liquid crystal voltage generator for supplying operating voltages V0 to V5 to each of drivers 3, 4, 5, and 6.

FIG. 2 is a sectional view showing part of color liquid crystal panel 2. A pair of glass plates 11*a* and 11*b* are spaced apart by a predetermined distance, and liquid crystal 12 is filled therebetween to constitute panel 2. Transparent scanning electrode 13 is formed on the inner surface of glass plate 11*a*, and signal electrodes 14, 15, and 16 of R, G, and B signals are arranged on glass plate 11*b*. R, G, and B color filters 17, 18 and 19 are formed on signal electrodes 14, 15, and 16, respectively. Deflecting plates 20*a* and 20*b* are formed on outer surfaces of glass plates 11*a* and 11*b*, respectively.

When color filters 17, 18, and 19 are formed on signal electrodes 14, 15, and 16, these filters are formed in units of colors. It is very difficult to uniformly form three different filters, causing variations in filter thickness. The variations cause differences in effective values of voltages at the liquid crystal even if a single voltage is applied thereto, thus degrading display quality. Japanese Utility Model Disclosure (Kokai) No. 61-124 describes a color liquid crystal panel drive circuit for providing a high quality display with good reproducibility even if the thicknesses of the R, G, and B filters are not uniform.

In the color liquid crystal panel drive circuit in Japanese Utility Model Disclosure (Kokai) No. 61-124, at least two of R, G, and B bias voltage generators have voltage regulators to variably regulate bias voltages, respectively.

Referring to FIG. 3, reference numeral 30 denotes a color liquid crystal panel. Panel 30 is driven by R signal electrode driver 31, G signal electrode driver 32, B signal electrode driver 33, and scanning electrode driver 34. Drivers 31, 32, 33, and 34 receive bias voltages from R, G and B bias voltage generators 35, 36, and 37. Assume a 1/13 bias voltage. As a generator 35 comprises five resistors series-connected between ground line GND and power source voltage Vcc, a potential difference between GND and Vcc is divided into 13 portions under the conditions where the resistance of the central resistor is 9R, and the resistances of other resistors are R each, thereby obtaining voltages

V0 to V5. Voltages V0, V1, V4, and V5 are supplied to scanning electrode driver 34, and voltages V0, V2, V3, and V5 are supplied to driver 31. A bias ratio is determined by a duty ratio of color liquid crystal panel 30. If the duty ratio is 1/N, bias ratio b is defined as $b=\sqrt{N}+1$. Generator 36 comprises three series-connected resistors and has one end connected to ground line GND and the other end connected to the sliding terminal of variable resistor 361. Resistor 361 is connected between power source voltages Vcc and Vcc'. Its regulated voltage is supplied to generator 36. Generator 36 generates voltages V2', V3', and V5' under the conditions where the resistance of the central resistor is 9R and the resistances of other resistors are R. Voltages V2', V3', and V5' as well as voltage V0 are supplied to G signal electrode driver 32. B bias voltage generator 37 comprises three series-connected resistors and has one end connected to ground line GND and the other end connected to the sliding terminal of variable resistor 371. Resistor 371 is connected between power source voltages Vcc and Vcc'', and its regulated voltage is supplied to generator 37. Generator 36 generates voltages V2'', V3'', and V5'' under the conditions where the resistance of the central resistor is 9R and the resistances of other resistors are R. Voltages V2'', V3'', and V5'', as well as voltage V0, are supplied to B signal electrode driver 33.

Display data system signal lines are omitted from FIG. 3.

In the conventional example in FIG. 3, voltage regulators of variable resistors 361 and 371 are respectively arranged in G and B bias voltage generators 36 and 37, respectively, thereby controlling the display colors on color liquid crystal panel 30. If resistor 361 is variably operated, a voltage supplied to generator 36 varies so that voltages V2', V3', and V5' supplied to G signal electrode driver 32 vary. If resistor 371 is variably operated, a voltage supplied to generator 37 varies so that voltages V2'', V3'', and V5'' supplied to B electrode driver 33 vary. Therefore, even if variations in thicknesses of R, G, and B filters occur, the effective values at the R, G, and B liquid crystal components can be set equal to each other, thereby obtaining high display quality.

However, when variable resistor 361 is adjusted to change R, G, and B signal electrode voltages, the effective voltage (X - Y) applied to the liquid crystal element during nonselection of the scanning electrode varies. More specifically, as shown in FIG. 4, if nonselection high level voltage V1 of the scanning electrode is defined as a reference, a biasing component of selection high level voltage V0 of the signal electrode differs from that of nonselection high level voltage V2 thereof. If nonselection low level voltage V4 of the scanning electrode is given as a reference, a biasing component of selection low level voltage V5 of the signal electrode differs from that of nonselection low level voltage V3 thereof. The liquid crystal cannot be driven according to a voltage averaging method using, e.g., 1/13 biasing. For this reason, if a color liquid crystal display is constituted by a matrix type liquid crystal display element, image degradation such as tailing occurs. U.S. Pat. No. 4,518,654 describes a liquid crystal television and illustrates a liquid crystal drive waveform. In addition, U.S. Pat. Nos. 3,945,000, 3,900,742, 3,936,676, 3,896,430, and 4,038,564 describe techniques for generating multi-level voltage signals for driving liquid crystals.

Further, Japanese Patent Publication No. 61-20000 discloses the technique of dividing a resistor to provide output signals of different voltages.

SUMMARY OF THE INVENTION

It is an object of the present invention to provide a liquid crystal drive circuit using a voltage averaging method for varying a segment voltage, wherein averaged bias segment voltages are output to drive a matrix type liquid crystal display element on the basis of the common voltage as a reference, so that image degradation such as tailing can be prevented.

In order to achieve the above object of the present invention, there is provided a liquid crystal drive circuit for driving a liquid crystal display element having scanning and signal electrodes arranged in matrix form comprising signal electrode voltage output means, constituted by a variable voltage divider of a series circuit consisting of voltage-dividing resistors and a variable resistor, for dividing a reference liquid crystal drive voltage and outputting a 1/n bias signal electrode voltage;

scanning electrode voltage output means, constituted by a series circuit of voltage-dividing resistors, for dividing the reference liquid crystal drive voltage and outputting at least a nonselection high level voltage and a nonselection low level voltage as the scanning electrode voltages;

first liquid crystal display element drive signal output means consisting of first buffer circuit means for receiving the selection high level voltage V0 from said signal electrode voltage output means and outputting a signal electrode voltage V0' of the same level as that of selection high level voltage V0, and a first operational amplifier for receiving nonselection high level voltage V1 as the scanning electrode voltage from said scanning electrode voltage output means and the selection high level voltage V0' as the signal electrode voltage from said first buffer circuit means, and for outputting a nonselection high level signal electrode voltage V2' having an inverted voltage level of the selection high level voltage V0' as the signal electrode voltage using the nonselection high level voltage V1 as the scanning electrode voltage as a reference; and second liquid crystal display element drive signal output means consisting of second buffer circuit means for receiving selection low level voltage V5 as the signal electrode voltage from said signal electrode voltage output means and outputting a selection low level voltage V5' as the signal electrode voltage having the same level as that of voltage V5, and a second operational amplifier for receiving a nonselection low level voltage V4 as the scanning electrode voltage from said scanning electrode voltage output means and the selection low level voltage V5' as the signal electrode voltage from said second buffer circuit means, and for outputting a nonselection low level voltage V3' as the signal electrode voltage having an inverted voltage level of the selection low level voltage V5' as the signal electrode voltage using the nonselection low level voltage V4 as the scanning electrode voltage as a reference.

Even if the segment voltage varies in the liquid crystal drive circuit having the arrangement described above, averaged bias segment voltages can be output using the common voltage as a reference.

DETAILED DESCRIPTION OF THE PREFERRED EMBODIMENT

Figure 1:
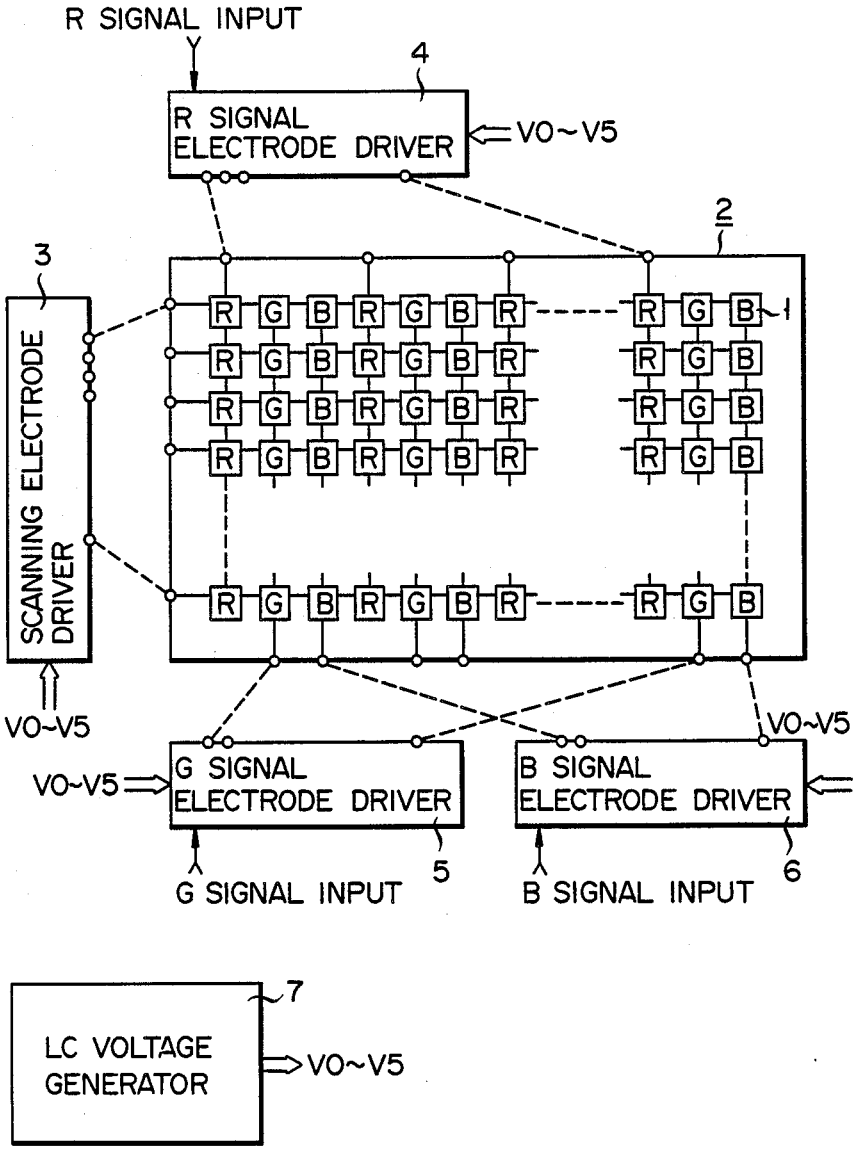
FIG. 1 (PRIOR ART)
FIG. 1 is a block diagram of a conventional color liquid crystal panel and its drive circuit.
Figure 2:
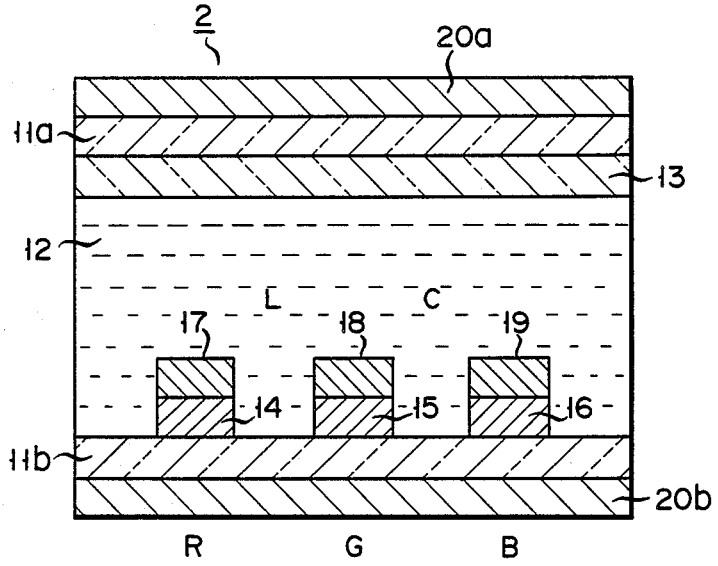
FIG. 2 (PRIOR ART)
FIG. 2 is a sectional view showing part of the color liquid crystal panel in FIG. 1.
Figure 3:
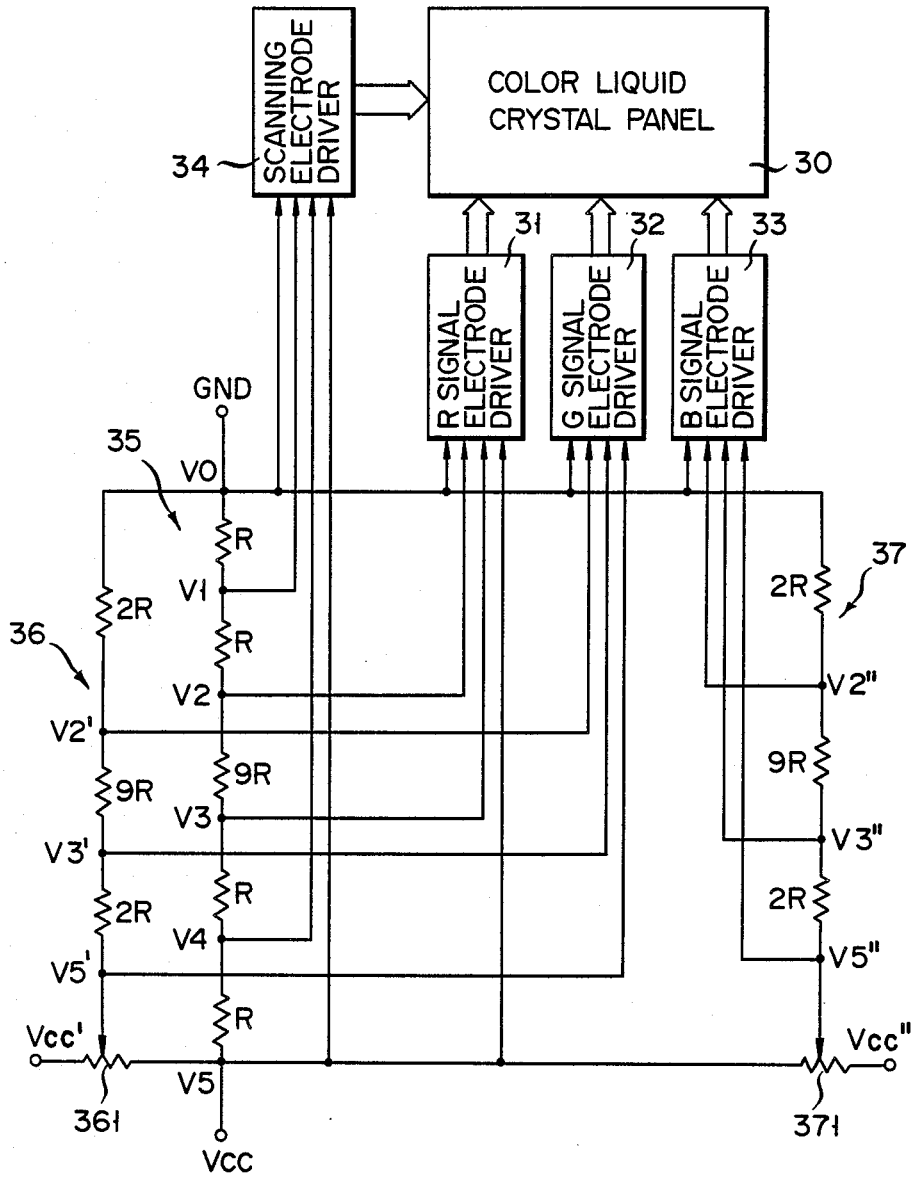
FIG. 3 (PRIOR ART)
FIG. 3 is a circuit diagram of bias voltage generators for driving the conventional liquid crystal panel.
Figure 4:
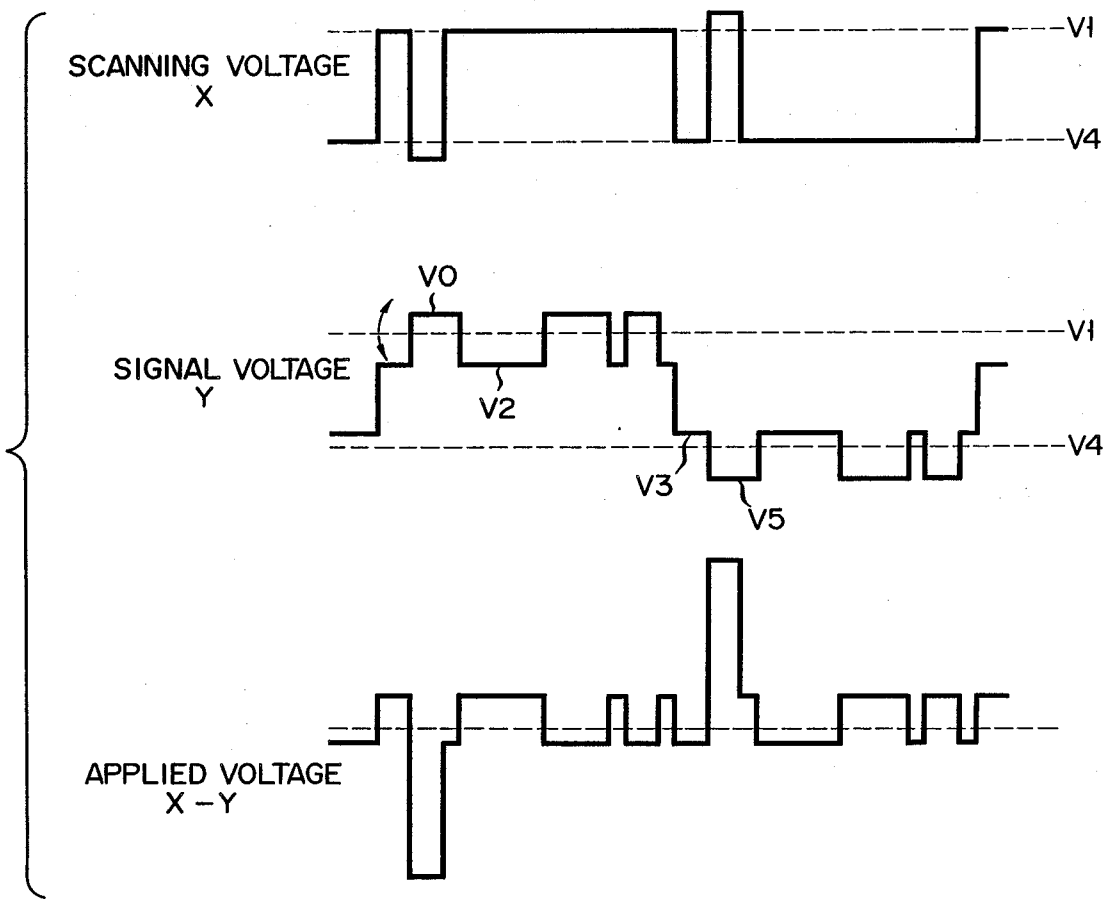
FIG. 4 (PRIOR ART)
FIG. 4 is a timing chart showing signals in the conventional liquid crystal drive circuit.
Figure 5:
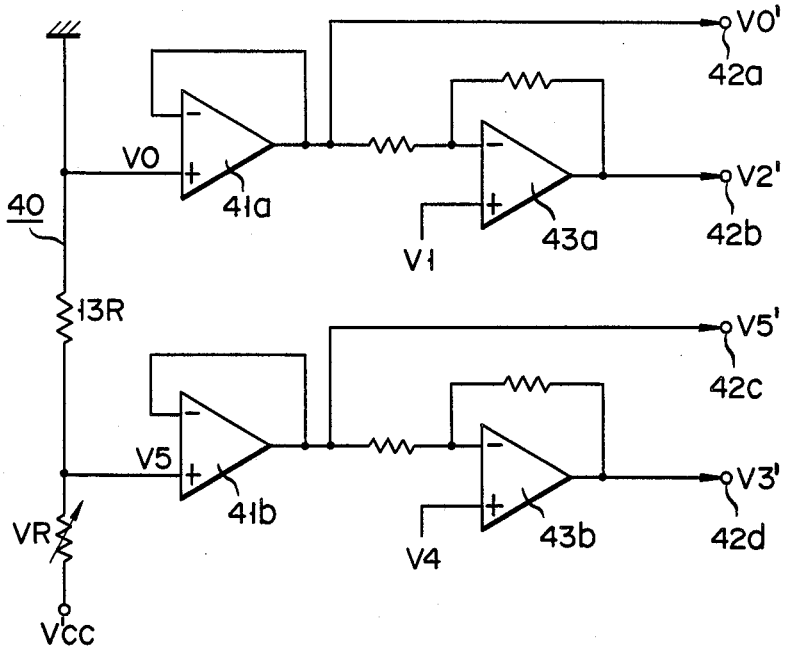
FIG. 5 is a circuit diagram showing a signal electrode voltage generator according to an embodiment of the present invention.
Figure 6:
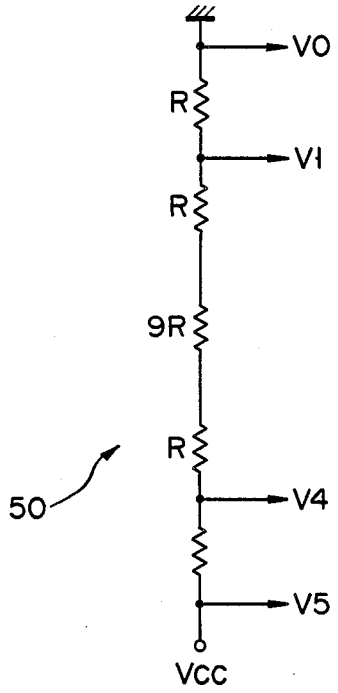
FIG. 6 is a circuit diagram showing a scanning electrode voltage generator according to the embodiment of the present invention.

A preferred embodiment of the present invention will be described with reference to the accompanying drawings. FIG. 5 is a circuit diagram of a signal electrode voltage generator according to an embodiment of the present invention. Referring to FIG. 5, voltage divider 40 generates, for example, 1/13 bias signal electrode voltages V0 and V5 obtained by dividing an input voltage by resistor 13R and variable resistor VR. Buffer circuit **41*a* supplies signal electrode voltage V0' to output terminal 42*a* and the inverting input terminal of operational amplifier 43*a*. Signal electrode voltage V0' has the same level as that of signal electrode voltage V0 from voltage divider 40. Buffer circuit 41*b* supplies signal electrode voltage V5' to output terminal 42*c* and the inverting input terminal of operational amplifier 43*b*. Signal electrode voltage V5' has the same level as that of signal electrode voltage V5 output from voltage divider 40. The noninverting input terminal of amplifier 43*a* receives scanning electrode voltage V1 (FIG. 6) from scanning electrode voltage generator 50, and its output terminal outputs voltage V2' to output terminal 42*b*. The noninverting input terminal of amplifier 43*b* receives scanning electrode voltage V4 from generator 50, and its output terminal outputs voltage V3' to output terminal 42*d***.

The operation of the circuit having the above arrangement will be described. A liquid crystal element having scanning and signal electrodes arranged in matrix form is driven by, e.g., 1/13 biasing. The scanning electrode voltage supplied to the scanning electrode is output from a voltage divider as in FIG. 6. Signal electrode voltages V0 and V5 are output from voltage divider 40 in FIG. 5. Voltages V0 and V5 can be varied by variable resistor VR.

Voltage V0 output from voltage divider 40 in the common nonselection mode is output to terminal **42*a* by buffer circuit 41*a* and serves as selection high level signal electrode voltage V0' having the same level as that of voltage V0. At the same time, voltage V0' is output to the inverting input terminal of amplifier 43*a*. Nonselection high level scanning electrode voltage V1 is input to the noninverting input terminal of amplifier 43*a*. Amplifier 43*a* outputs segment voltage V2' of an inverted voltage level of high level voltage V0' to output terminal 42*b* when scanning electrode voltage V1** is used as a reference. Voltage V2' is a nonselection high level signal electrode voltage.

Signal electrode voltage V5 from voltage divider 40 is output as selection low level signal electrode voltage V5' to output terminal 42c by buffer circuit 41b. Voltage V5' has the same level as that of voltage V5. At the same time, voltage V5' is input to the inverting input terminal of amplifier 43b. Nonselection low level scanning electrode voltage V4 is input to the noninverting input terminal of amplifier 43b. Amplifier 43b supplies signal electrode voltage V3' to output terminal 42d. Voltage V3' has an inverted voltage level of low level signal electrode voltage V5' with scanning electrode voltage V4 as a reference. Voltage V3' is a nonselection low level signal electrode voltage.

Figure 7:
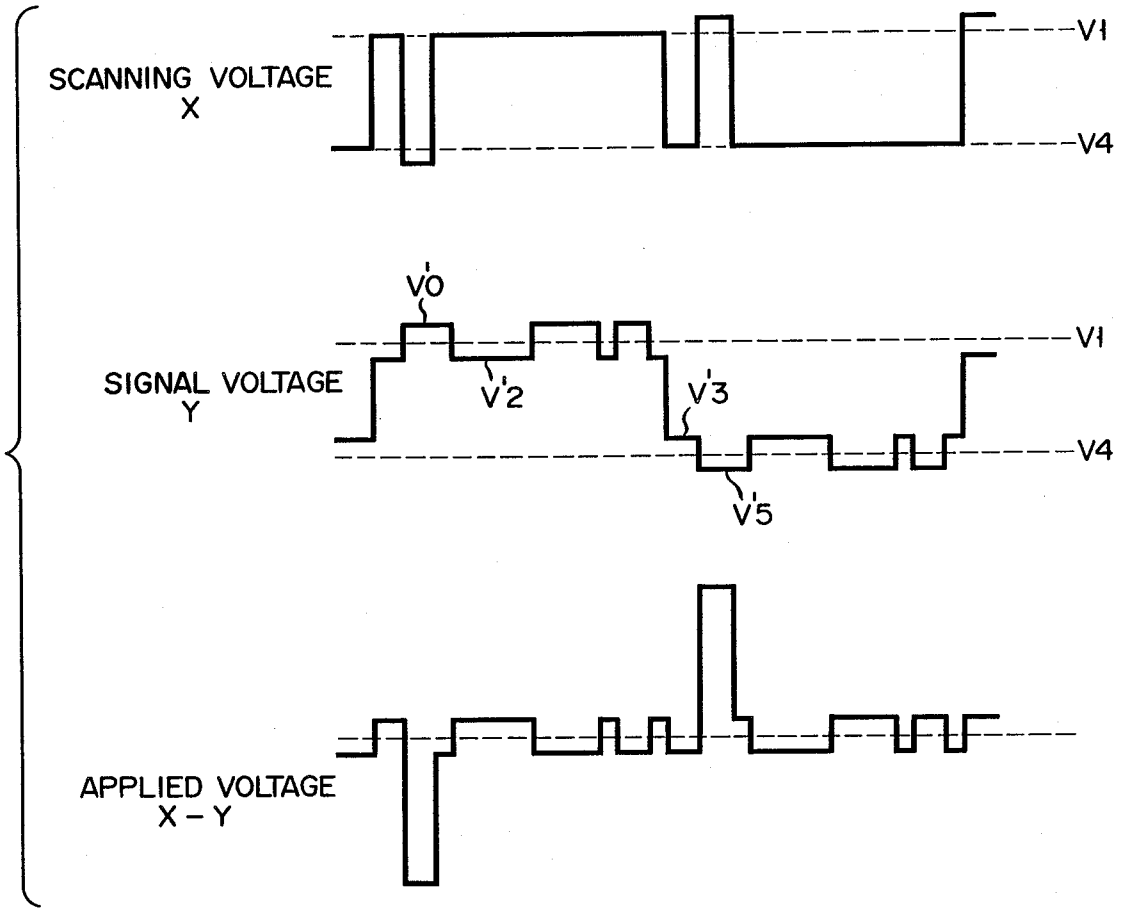
FIG. 7 is a timing chart showing signals from signal and scanning voltage generators.

By outputting voltages V0', V2', V3', and V5' with respect to the scanning electrode voltage, a voltage shown in FIG. 7 can be applied to the matrix type liquid crystal element. Signal electrode voltages V0', V2', V3', and V5' in FIG. 5 are supplied to the R, G, and B electrodes. In this case, variable resistor VR is adjusted independently for the R, G, and B electrodes to regulate voltages V0', V2', V3', and V5' to optimal levels. Although signal electrode voltages V0' and V5' vary, voltages V2' and V3' are output as voltages having the inverted voltage levels of voltages V0' and V5' by using the scanning electrode voltage as a reference. In other words, signal electrode voltages V0' and V2' constantly serve as bias voltages averaged using scanning electrode voltage V1 as a reference, and signal electrode voltages V3' and V5' constantly serve as bias voltages averaged using scanning electrode voltage V4 as a reference.

In the above embodiment, signal electrode voltages V2' and V3' as the inverted voltages of signal electrode voltages V0' and V5' are generated with reference to scanning electrode voltages V1 and V4. However, as shown in FIG. 8, signal electrode voltages V0' and V5' as inverted voltages of signal electrode voltages V2' and V3' may be generated with reference to scanning electrode voltages V1 and V4.

Figure 8:
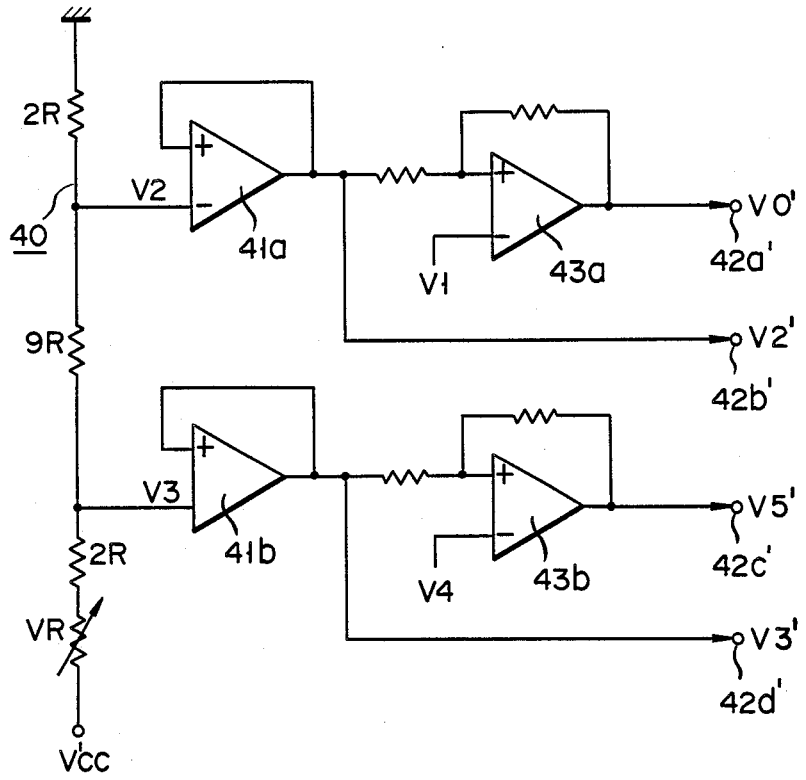
FIG. 8 is a view showing another embodiment of the present invention.

As shown in FIG. 8, an embodiment of a liquid crystal drive circuit for driving a liquid crystal display element having scanning and signal electrodes arranged in matrix form, comprises signal electrode voltage output means which comprises a variable voltage divider 40 including voltage-dividing series-connected resistors and a variable resistor, for dividing a reference liquid crystal drive voltage and outputting a 1/n bias signal electrode voltage, where n is a number greater than one. Scanning electrode voltage output means is provided which comprises a series circuit 50 including voltage-dividing resistors, for dividing the reference liquid crystal drive voltage and outputting at least a nonselection high level voltage V1 and a nonselection low level voltage V4 as scanning electrode voltages. A first liquid crystal display element drive signal output means comprises a first buffer circuit 41a for receiving a nonselection high level voltage V2 as a signal electrode voltage from said signal electrode voltage output means and outputting a nonselection high level voltage V2' as a signal electrode voltage of the same level as that of the nonselection high level voltage V2; and a first operational amplifier 43a for receiving a nonselection high level voltage V1 as the scanning electrode voltage from said scanning electrode voltage output means and the nonselection high level voltage V2' as the signal electrode voltage from said first buffer circuit 41a, and for outputting a selection high level voltage V0' as the signal electrode voltage having an inverted voltage level of the nonselection high level voltage V2' as the signal electrode voltage using the nonselection high level voltage V1 from said scanning electrode voltage output means as a reference. A second liquid crystal display element drive signal output means comprises a second buffer circuit 41b for receiving a nonselection low level voltage V3 as the signal electrode voltage from said signal electrode voltage output means and for outputting a nonselection low level voltage V3' as the signal electrode voltage having the same level as that of said signal electrode voltage V3 from the signal electrode voltage output means; and a second operational amplifier 43b for receiving a nonselection low level voltage V4 as the scanning electrode voltage from said scanning electrode voltage output means and the nonselection low level voltage V3' as the signal electrode voltage from said second buffer circuit 41b, and for outputting a selection low level voltage V5' as the signal electrode voltage having an inverted voltage level of the nonselection low level voltage V3' output from said second buffer circuit 41b as the signal electrode voltage using the nonselection low level voltage V4 from said scanning electrode voltage output means as a reference.

What is claimed is:

1. A liquid crystal drive circuit for driving a liquid crystal display element having scanning and signal electrodes arranged in matrix form, comprising:

signal electrode voltage output means comprising a variable voltage divider including voltage-dividing series-connected resistors and a variable resistor, for dividing a reference liquid crystal drive voltage and outputting a 1/n bias signal electrode voltage, where n is a number greater than one;

scanning electrode voltage output means comprising a series circuit including voltage-dividing resistors, for dividing the reference liquid crystal drive voltage and outputting at least a nonselection high level voltage (V1) and a nonselection low level voltage as scanning electrode voltages;

first liquid crystal display element drive signal output means comprising first buffer circuit means for receiving a selection high level voltage (V0) from said signal electrode voltage output means and outputting a signal electrode voltage (V0') of the same level as that of said selection high level voltage (V0) from said signal electrode voltage output means, and a first operational amplifier for receiving a nonselection high level voltage (V1) as the scanning electrode voltage from said scanning electrode voltage output means and the selection high level voltage (V0') as the signal electrode voltage from said first buffer circuit means, and for outputting a nonselection high level signal electrode voltage (V2') having an inverted voltage level of the selection high level voltage (V0') output from said first buffer circuit means as the signal electrode voltage using the nonselection high level voltage (V1) from said scanning electrode voltage output means as a reference; and second liquid crystal display element drive signal output means comprising second buffer circuit means for receiving a selection low level voltage (V5) as the signal electrode voltage from said signal electrode voltage output means and for outputting a selection low level voltage (V5') as the signal electrode voltage having the same level as that of siad selection low level voltage (V5) from said signal electrode voltage output means, and a second operational amplifier for receiving a nonselection low level voltage (V4) as the scanning electrode voltage from said scanning electrode voltage output means and the selection low level voltage (V5') as the signal electrode voltage from said second buffer circuit means, and for outputting a nonselection low level voltage (V3') as the signal electrode voltage having an inverted voltage level of the selection low level voltage (V5') from said second buffer circuit means as the signal electrode voltage using the nonselection low level voltage (V4) from said scanning electrode voltage output means as a reference.

2. A liquid crystal drive circuit for driving a liquid crystal display element having scanning and signal electrodes arranged in matrix form, comprising:

signal electrode voltage output means, comprising a variable voltage divider including voltage-dividing series-connected resistors and a variable resistor, for dividing a reference liquid crystal drive voltage and outputting a 1/n bias signal electrode voltage, where n is a number greater than one;

scanning electrode voltage output means, comprising a series circuit including voltage-dividing resistors, for dividing the reference liquid crystal drive voltage and outputting at least a nonselection high level voltage (V1) and a nonselection low level voltage (V4) as scanning electrode voltages;

first liquid crystal display element drive signal output means comprising first buffer circuit means for receiving a nonselection high level voltage (V2) as a signal electrode voltage from said signal electrode voltage output means and outputting a nonselection high level voltage (V2') as a signal electrode voltage of the same level as that of the nonselection high level voltage (V2) from said signal electrode voltage output means, and a first operational amplifier for receiving a nonselection high level voltage (V1) as the scanning electrode voltage from said scanning electrode voltage output means and the nonselection high level voltage (V2') as the signal electrode voltage from said first buffer circuit means, and for outputting a selection high level voltage (V0') having an inverted voltage level of the nonselection high level voltage (V2') output from said first buffer circuit means as the signal electrode voltage using the nonselection high level voltage (V1) from said scanning electrode voltage as a reference; and second liquid crystal display element drive signal output means comprising second buffer circuit means for receiving a nonselection low level voltage (V3) as the signal electrode voltage from said signal electrode voltage output means and for outputting a nonselection low level voltage (V3') as the signal electrode voltage having the same level as that of said nonselection low level voltage (V3) from said signal electrode voltage output means, and a second operational amplifier for receiving a nonselection low level voltage (V4) as the scanning electrode voltage from said scanning electrode voltage output means and the nonselection low level voltage (V3') as the signal electrode voltage from said second buffer circuit means, and for outputting a selection low level voltage (V5') as the signal electrode voltage having an inverted voltage level of the nonselection low level voltage (V3') from said second buffer circuit means as the signal electrode voltage using the nonselection low level voltage (V4) from said scanning electrode voltage output means as a reference.

* * * * *